United States Patent [19]

Mikaila

[11] 4,132,271

[45] Jan. 2, 1979

[54] FRAGMENT PREVENTION SCREEN FOR EXPLODABLE FIRE SUPPRESSANT PANELS

[75] Inventor: Joseph J. Mikaila, Troy, Mich.

[73] Assignee: The United States of America as represented by the Secretary of the Army, Washington, D.C.

[21] Appl. No.: 814,354

[22] Filed: Jul. 11, 1977

[51] Int. Cl.[2] ..... A62C 35/12

[52] U.S. Cl. ..... 169/62; 169/66; 220/426; 220/88 R

[58] Field of Search ..... 169/62, 66; 220/63 A, 220/88 R, 88 A, 88 B

[56] References Cited

U.S. PATENT DOCUMENTS

| | | | |
|---|---|---|---|
| 2,743,035 | 4/1956 | Fogarty | 220/88 A |
| 3,830,261 | 8/1974 | Hochberg et al. | 220/63 A X |
| 3,930,541 | 1/1976 | Bowman et al. | 169/62 |

*Primary Examiner*—Johnny D. Cherry
*Attorney, Agent, or Firm*—Peter A. Taucher; John E. McRae; Nathan Edelberg

[57] ABSTRACT

A military vehicle equipped with a hollow panel containing a fire suppressant, the panel being located directly inboard from one of the vehicle fuel tanks, whereby enemy projectiles fired into the tank also penetrate the panel; fire suppressant sprays out of the hole formed by the projectile, thereby preventing formation of or extinguishing a potential fireball within the vehicle before it can grow into a massive holocaust of lethal proportions. A foraminous screen is positioned on the inboard face of the panel to prevent the panel from fragmenting as the suppressant enlarges the hole formed by the projectile.

1 Claim, 8 Drawing Figures

Fig-4
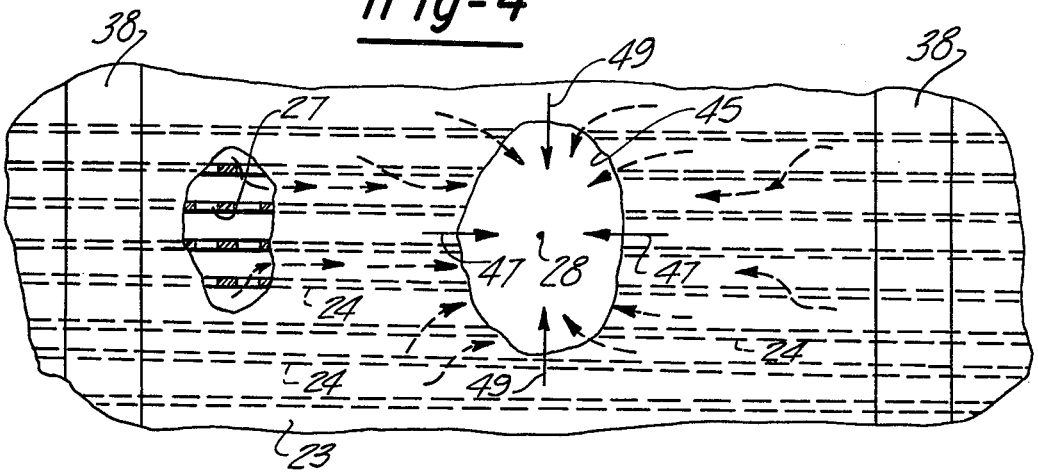
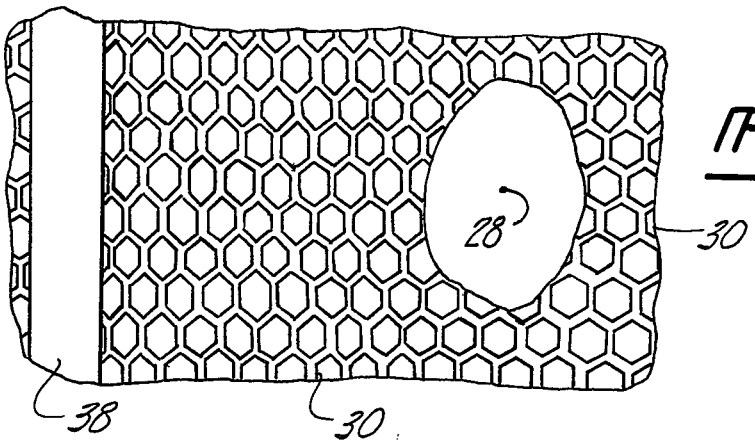
Fig-5
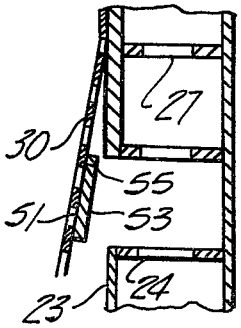
Fig-8
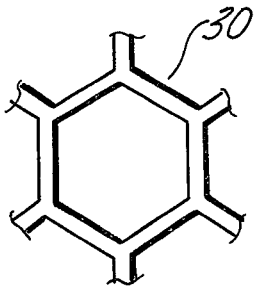
Fig-6
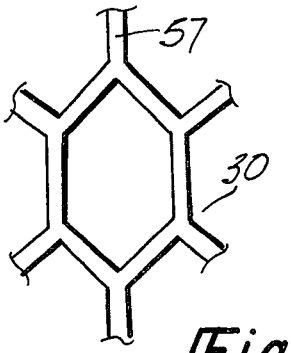
Fig-7

FRAGMENT PREVENTION SCREEN FOR EXPLODABLE FIRE SUPPRESSANT PANELS

The invention described herein may be manufactured, used, and licensed by or for the Government for governmental purposes without payment to me of any royalty thereon.

BACKGROUND AND SUMMARY OF THE INVENTION

U.S. Pat. No. 3,930,541 issued to Bowman et al and U.S. patent application Ser. No. 786,737 by E. J. Roznieckі disclose fire suppressant systems for military vehicles. Both systems include hollow metallic panels positioned inboard from the vehicle fuel tank so that enemy projectiles fired into the tank also pass through the hollow panel. Pressurized fire suppressant discharges through the hole formed by the projectile to impact against the fireball generated in the personnel space or engine compartment; the fire suppressant rapidly intermixes with the developing flame to thereby extinguish it before it can explode into holocaust proportions. With this system fireballs have been extinguished in less than 100 milliseconds after passage of the projectile through the panel.

The rapid fire-out time is at the expense of undesired fragmentation of the panel material as the pressurized suppressant enlarges the hole formed by the projectile. The suppressant gas at high pressure (e.g. 900 p.s.i.) attacks the edges of the hole and generates cracks in the surrounding wall material; as the cracks radiate outwardly from the edge of the hole they tend to tear the material away from the panel and into the blast of fast-moving suppressant. If the area inboard from the fire-suppressant panel is a personnel space there is a danger that the flying panel fragments will cause human injury or death.

The present invention provides an anti-fragmentation screen on the inboard face of the hollow panel. The screen has a porous nature that enables the hole to be enlarged by the pressurized suppressant. However the screen walls absorb the force of the torn panel material to prevent the material from fragmenting and blowing into the personnel space.

THE DRAWINGS

FIG. 4 is a frontal view of a fire-suppressant panel illustrating the presumed manner of crack propagation by the suppressant pressure.

FIG. 5 is similar to FIG. 4 but showing the effect a foraminous screen has on crack propagation.

FIGS. 6, 7 and 8 are enlarged views of one area of the screen, showing its capability for absorbing forces generated by the suppressant.

Figure 2:
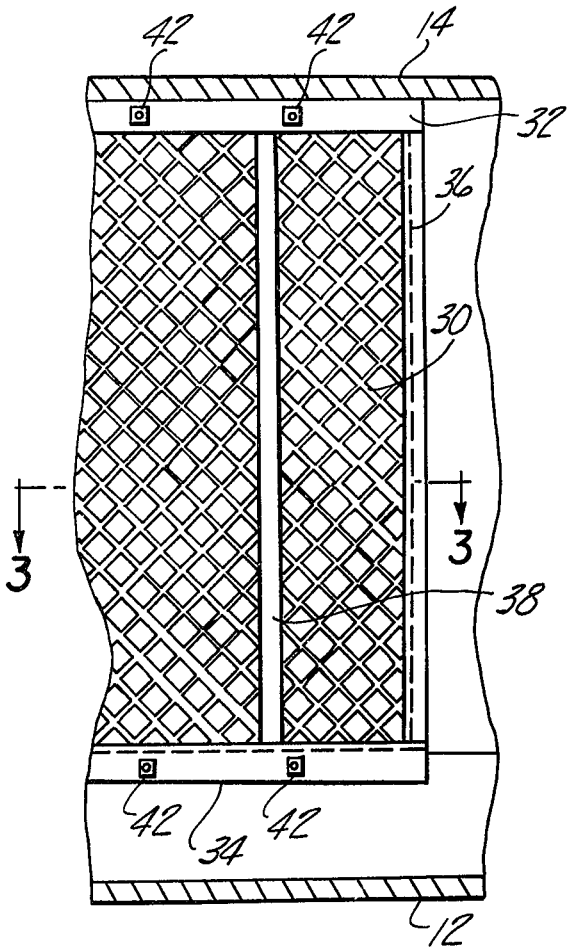
FIG. 2 is a view taken on line 2—2 in FIG. 1.
Figure 1:
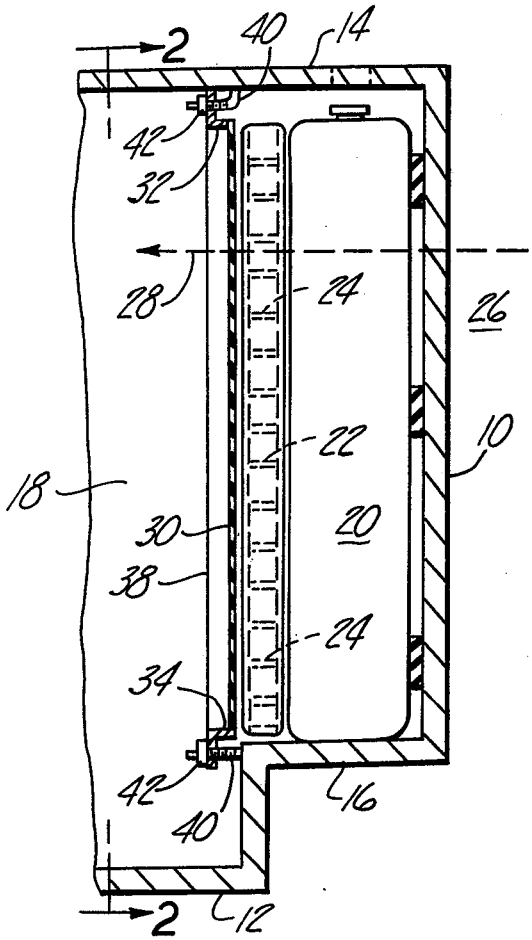
FIG. 1 is a view taken through a section of a military vehicle incorporating the features of this invention.

There is shown in FIG. 1 a tracked military vehicle, e.g. a personnel carrier, comprising a side wall 10, floor 12, roof 14, and horizontal wall or ledge 16. The area below wall 16 accommodates one of the ground-engaged tracks that move the vehicle along. Central space 18 accommodates military personnel. The non-illustrated half of the vehicle would be a mirror image of that shown.

Positioned directly above wall 16 is fuel tank 20. Immediately inboard from the tank is a hollow panel 22 containing pressurized fire-suppressant, e.g. Halon 1301 ($CF_3Br$). Typically the suppressant is at a pressure in the neighborhood of 900 p.s.i. Panel 22 and fuel tank 20 would be coextensive in the height and length dimensions; the tank would be somewhat thicker than the panel in the width dimension. As an example, the fuel tank might have a height of about two or three feet, a length of about four feet, and a thickness on the order of one foot. Panel 22 would have similar height and length dimensions, but a lesser thickness of about one or two inches. The hollow panel is reinforced against rupture from suppressant pressures by means of partitions 24 running lengthwise in the space between the major walls of the panel; each partition is welded to the panel walls to achieve the desired reinforcement action.

The hollow fire-suppressant panel 22 is arranged immediately inboard from tank 20 so that enemy projectiles fired into the tank from external space 26 would also pass through panel 22; one of several projectile path lines is designated in FIG. 1 by numeral 28. The hole formed in the panel by the projectile will provide an escape path for pressurized suppressant; the suppressant will spray into personnel space 18 along with fuel from tank 20 so that the fireball generated in space 18 will be extinguished in one tenth second or less (determined from high speed movies of experimental test set-ups).

Immediately after the projectile passes through the inboard wall of hollow panel 22 the outrushing fire-suppressant gas enlarges the hole to provide a gas escape path. Hole enlargement is accompanied by a tendency for the panel wall material to fragment into particles; such particles can be carried along with the gas into personnel space 18, thereby posing a potential danger to the personnel. To prevent or minimize the danger of flying fragments the present invention provides a foraminous screen 30 immediately inboard from panel 22. Screen 30 is stretched taut within a rigid frame comprised of an upper angle iron 32, lower angle iron 34, two vertical angle irons 36, and two intermediate vertical bars 38. Tack welding may be used to anchor the screen to spaced areas around the rigid frame. The screen-frame unit has a face area coextensive with that of panel 22. Bars 38 are optional parts of the frame.

The screen-frame unit is mounted on the inboard face of panel 22 by means of studs 40 affixed to the vehicle; holes in angle irons 32 and 34 telescope onto the studs, after which the nuts 42 are tightened down on the studs to clamp the screen-frame unit against panel 22.

Figure 3:
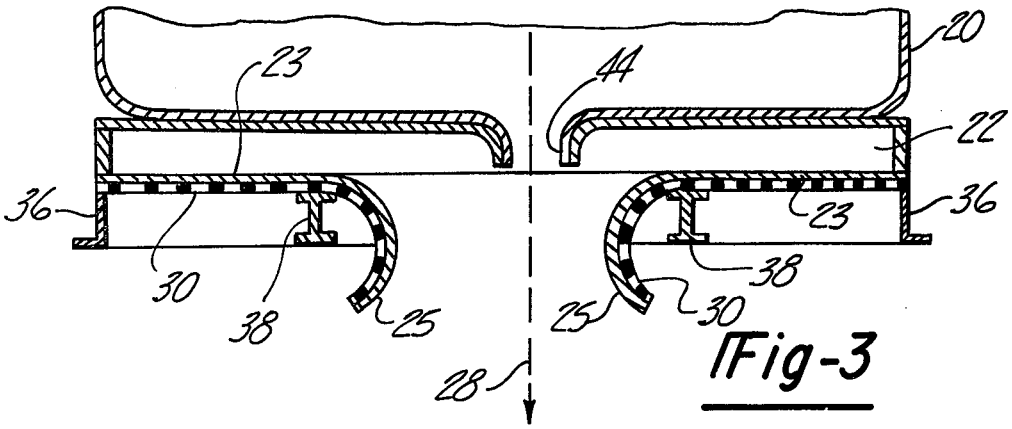
FIG. 3 is a sectional view taken on line 3—3 in FIG. 2 after a projectile has been fired through the fuel tank and fire-suppressant panel.

FIG. 1 shows the components in semi-separated positions prior to final tightening-down of nuts 42. FIG. 3 shows the assembly after a projectile has passed therethrough along path line 28. The projectile forms a relatively small hole 44 in the inboard wall of tank 20 and the outboard wall of panel 22. As the projectile passes through the inboard wall 23 of panel 22 an escape path is formed for the pressurized fire suppressant contained within the panel. The pressure of the escaping gas forms cracks in areas of wall 23 at the edge of the hole formed by the projectile. Areas 25 of the wall thus peel outwardly and then laterally as the gaseous stream diverges from the mean path line 28 (see FIG. 3). When the hole is formed in the central area of panel 22 the extent of the peel-back action is limited by the rigid bars 38 (when they are used). Screen 30 peels back with wall 23.

The directional configurations of the peel-backs 25 in wall 23 are determined at least partly by the orientations of the previously mentioned partitions 24 within panel 22. As shown in FIG. 4, the partitions extend horizontally for the full length of panel 22; numeral 27 refers to circular port openings formed at spaced points along each partition for promoting high mass flow of gas toward the hole formed by the projectile (as more completely explained in aforementioned patent application, Ser. No. 786,737). Since the partitions 24 are welded to wall 23 the material of wall 23 tends to tear along horizontal lines coincident with the edges of the partitions; the wall material peels outwardly in horizontal strips, similar to the pages in a book when it is initially opened.

The peel-back action is believed to be caused primarily by the pressures of the gas outflowing from panel 22, rather than from the projectile. Referring to FIG. 4, the hole 45 formed by the projectile enables the high pressure gas to flow toward the hole and then outwardly as shown by the horizontal directional arrows 47 and vertical directional arrows 49. In general the horizontal flow 47 is believed to be faster or more predominate because the gases can more readily flow between partitions 24 rather than through the port openings 27 in the partitions. In this connection the port openings 27 correspond functionally to similar port openings 52 described in previously mentioned patent application Ser. No. 786,737. The aim of the port openings is to promote a massive flow of gas from all zones of the panel toward the hole formed by the projectile; however the vertical flow 49 through the ports is somewhat more restricted than the horizontal flow 47 between the partitions.

The horizontal force components 47 tend to outwardly peel the wall 23 material in horizontal planes, whereas the vertical force components 49 tend to outwardly peel the wall 23 material in vertical planes. At points above the projectile hole pathline 28 the wall material tends to be thrown at a slight upward tilt; at points below pathline 28 the material tends to be thrown out at a slight downward tilt. Secondary tear or crack lines are presumed to be generated at angles to the length of the peeled-out strips. The strips thereby tend to be torn away after initial formation. When there is no screen 30, as in FIG. 4, the strip fragments fly into the personnel space. It is theorized that screen 30 tends to partially absorb the force of the peeled-back walls 25 to minimize the secondary cracks. FIG. 8 shows a peeling leaf 53 as it is breaking away from partitions 24. In FIG. 8 the screen is shown engaged with the most advanced part 51 of the peeling leaf 53. The screen is believed to retard the motion of advance part 51 so the trailing part 55 of the leaf is able to catch up to the advance part. In this manner the leaf peels back in a regular non-oblique fashion as shown in FIG. 3; little or no fragmentation of wall 23 takes place.

Tests have been conducted using imperforate sheets in place of screen 30. However the results were not as good as when the screen was used. In general the sheet tended to restrict the size of the opening in the fire-suppressant panel so that discharge rate of the suppressant was lessened; the fire-out times were increased although still under 0.1 seconds; the imperforate sheet did achieve the desired anti-fragmenting action. It is preferred to use a screen in order to achieve quicker fire-out times.

The exact gauge of the screen for best fragment-containment action is not known. Test work was performed with screen formed of conventional expanded metal having openings of about one inch diameter. The screen should offer a measure of resistance commensurate with expected load; window screen would not be sufficient. The openings in the screen should offer minimum resistance to flow of pressurized suppressant.

Screen 30 is not a massive support structure or containment structure. It probably should be yieldable or stretchable to conform to the peeled strips of wall 23. Expanded metal would appear to be a good material because it can stretch slightly in response to load forces. For example, as seen in comparison of FIGS. 6 and 7, the strand walls 57 of the screen can stretch or yield apart when a load produces a directional tension of the screen material.

I wish it to be understood that I do not desire to be limited to the exact details of construction shown and described for obvious modifications will occur to a person skilled in the art.

I claim:

1. In a military vehicle having an internal fuel tank disposed in close adjacency to one of the vehicle external walls, a hollow panel containing pressurized fire suppressant, said panel being located immediately inboard from the fuel tank so that one wall of the panel lies flatwise against a major wall of the tank, said panel and fuel tank having approximately the same profile normal to said one external wall whereby the panel intercepts enemy projectiles fired into the fuel tank from external areas alongside the vehicle: the improvement comprising an anti-fragmentation foraminous screen coextensive with the fire suppressant panel; frame means defining a rigidifying border that anchors the screen at selected points around its peripheral edge; means (40,42) trained between the vehicle and frame for drawing the frame-screen unit tightly against the inboard wall of the fire suppressant panel, whereby the screen tends to minimize the tendency of the panel material to fragment into separate particles as the suppressant enlarges a hole initially formed by the projectile; the screen being an expanded metal screen having a capability of stretching in response to the forcible movement of panel wall elements thereagainst; the screen being formed so that the screen openings are about one inch in diameter; the screen being the sole layer of material on the inboard wall of the fire suppressant panel, whereby the hole enlargement action of the suppressant is substantially unaffected by the screen structure.

* * * * *